US005289898A

United States Patent [19]

Oberg

[11] Patent Number: 5,289,898

[45] Date of Patent: Mar. 1, 1994

[54] METHOD AND APPARATUS FOR MAINTAINING LUBRICANT IN AN INTERNAL COMBUSTION ENGINE

[76] Inventor: Donald F. Oberg, 309 S. Linwood Beach, Linwood, Mich. 48634

[21] Appl. No.: 8,591

[22] Filed: Jan. 25, 1993

[51] Int. Cl.[5] ..... F16C 3/14

[52] U.S. Cl. ..... 184/1.5; 184/103.1; 184/105.1; 123/196 S

[58] Field of Search ..... 184/1.5, 96, 97, 103.1, 184/105.1, 106; 123/196 S

[56] References Cited

U.S. PATENT DOCUMENTS

| | | | |
|---|---|---|---|
| 1,503,334 | 7/1924 | Norris | 184/103.1 |
| 3,712,420 | 1/1973 | Pelizzoni et al. | 184/105.1 |
| 4,299,307 | 11/1981 | Scott | 184/1.5 |

*Primary Examiner*—Thomas E. Denion
*Attorney, Agent, or Firm*—John J. Swartz

[57] ABSTRACT

Apparatus for maintaining the quality of lubricant and level of lubricant in an internal combustion engine without having to remove lubricant. The oil pan or crank case normally mounted on the underside of an internal combustion engine is modified to include a deep well in the lower wall thereof which has a breadth substantially less than the breadth of the oil pan so that a substantially reduce volume of oil is required to safely operate the engine. Apparatus is also provided for supplying make-up lubricant to the engine while the engine is operating and includes an air impervious reservoir containing make-up lubricant. A conduit is coupled to the lower end of the reservoir and is received in the deep well. The conduit includes a lower end having a discharge opening disposed at the level of lubricant in the well when the engine is operating. If lubricant is dissipated and the level of lubricant drops below the opening, make-up lubricant falls, under the force of gravity, through the conduit until the level again rises to cover the opening.

12 Claims, 2 Drawing Sheets

METHOD AND APPARATUS FOR MAINTAINING LUBRICANT IN AN INTERNAL COMBUSTION ENGINE

BACKGROUND OF THE INVENTION

1. Field of the Invention

This invention relates to a liquid lubricating system for an internal combustion engine and more particularly to a system which will reduce the volume of liquid lubricant in the system required to safely operate the system and more easily and continually supply make-up liquid lubricant as the lubricant is dissipated.

2. Description of the Prior Art and Objects

Conventionally, internal combustion engines are lubricated with oil which is normally stored in a so-called "oil pan" or crank case that is mounted on the underside of the engine. An oil pump, normally mounted within the oil pan, pumps oil from the pan to various moving parts such as pistons, valve lifters, etc. After continued use, some of the oil may leak out of the circulating system or be otherwise dissipated to reduce the volume of oil in the circulating, liquid lubricating system. Traditionally, as the oil is dissipated, the user will add oil to bring the level back up to the desired level. In an internal combustion engine having a five quart capacity of lubricating oil, oil is traditionally added in one quart increments. A substantial part of the oil in the system is "used" or old compared to the portion of oil which has been newly added. It is desirable that the proportion of new oil to old or "used" oil be as high as possible to increase the lubricating characteristics of the lubricating system. Accordingly, it is an object of the present invention to provide apparatus which will increase the proportion of fresh or new oil relative to the portion of "used" or old oil heretofore utilized in internal combustion engines.

It is another object of the present invention to provide a new and novel apparatus for maintaining the volume of liquid lubricant in an internal combustion lubricating system.

It is a further object of the present invention to provide new and novel apparatus for constantly monitoring the level of liquid in an operating engine and for constantly applying make-up lubricant as the lubricant is dissipated.

It has also been found desirable to utilize as much fresh or new oil in the system as possible to efficiently flush the engine of contaminates. Accordingly, it is another object of the present invention to provide new and novel apparatus for maintaining the level of lubricant with a higher proportion of fresh oil to better flush the engine of contaminates.

Also typical is the so-called "oil change" whereby the engine operator will periodically completely remove the "used oil" in an engine and replace it with new or fresh oil. For years, such waste oil has merely been deposited back into the earth which has caused substantial ecological and contamination problems. With the advent of current environmental protection agency standards, the consumption, destruction or elimination of waste oil has become a substantial problem. With the apparatus constructed according to the present invention, it is never necessary to remove used oil from the system as fresh oil is constantly supplied to the system whenever necessary. As the engine "consumes" the oil, fresh make-up oil is provided. Accordingly, it is an object of the present invention to provide a make-up lubricant system for an internal combustion engine which will eliminate the necessity of "changing oil".

In the typical internal combustion engine, the oil pan or crank case mounted below the engine has a relatively great breadth. Accordingly, although the engine may only require one-half quart of oil to lubricate it any any one time, it has been conventional to store five quarts in the crank case in order to cover the inlet orifice of the oil pump when the engine is operating and the level of oil in the crank case lowers. It has been found according to the present invention that the inclusion of a deep well, having a breadth substantially less than the breadth of the oil pan, will reduce the total volume of oil required in the system. With the high volume of internal combustion engines operating throughout the world, a substantial .savings in oil reserves could easily be appreciated if the total oil required was decreased. It is an object of the present invention to provide a new and novel lubricant storage pan of the type described for receiving and storing a lower volume of liquid lubricant than has been required heretofore.

It is another object of the present invention to provide apparatus for maintaining the oil level in an internal combustion engine substantially constant and continually supplied with fresh oil as needed without ever having need to "change the oil" or otherwise remove oil from the system.

It is another object of the present invention to provide apparatus for maintaining a constant oil level which includes a make up oil reservoir which stores the reserve oil heretofore stored in the "oil pan".

Apparatus has been provided heretofore for maintaining the level of lubricating oil in an internal combustion system such as that disclosed in U.S. Pat. No. 2,615,442 issued to C. T. Berry on Oct. 28, 1952. The lubricating apparatus illustrated in the Berry patent includes a relatively complicated valve system which is coupled into the vacuum system associated with the engine manifold. Accordingly, it is an object of the present invention to provide new and novel, relatively inexpensive and simple apparatus for maintaining constant the correct level of lubricating in the crank case of an internal combustion engine.

The U.S. Pat. No. 4,724,926 issued to Lonnie L. Collins on Feb. 16, 1988 also discloses apparatus for maintaining a level of lubricating oil in an internal combustion engine, however, the system likewisely discloses a complicated valving arrangement and operates only when an engine is inoperative as opposed to when then engine is operative. Such a prior art system, of course, risks the possibility of having an insufficient quantity of oil while the engine is operating. Accordingly, it is an object of the present invention to provide apparatus of the type described for maintaining a correct level of lubricating oil in the oil pan of an internal combustion engine while the engine is operating.

It is another object of the present invention to provide a method of maintaining the quality of liquid lubricant in an internal combustion engine by supplying make-up liquid lubricant from a storage reservoir to an oil pan via gravity only.

It is another object of the present invention to provide an engine oil storage and lubricating system which utilizes only slightly more than the minimal amount of oil required to lubricate the system.

It is another object of the present invention to provide oil level maintaining apparatus of the type described which includes a translucent oil reservoir that is used to in situ visually indicate a proper oil level without the use of a conventional "dip stick" that must be withdrawn from an oil pan.

Other objects and advantages of the present invention will become apparent to those of ordinary skill in the art as the description thereof proceeds.

SUMMARY OF THE INVENTION

Apparatus for supplying make-up liquid lubricant to a lubricant storage pan normally filled with liquid lubricant to a predetermined level in an operating internal combustion engine having lubricant circulating mechanism for circulating lubricant from the pan to the engine and reduce the level of lubricant in the pan to a lower predetermined level. The apparatus includes an air impervious reservoir mounted at a level above the lower predetermined level and having a lower discharge end. A gravity feed conduit, having an upper end coupled to, and an open liquid communication with the lower discharge of the reservoir, has a lower end received by the pan and includes an-opening at the predetermined level for passing make-up lubricant from the reservoir to the pan when the level of lubricant in the pan reaches a level below the predetermined level and for interrupting a flow of make-up lubricant from the reservoir to the pan when the lubricant reaches the predetermined level and closes the opening. One aspect of the invention includes an oil pan having a deep well which stores a quantity of oil only slightly greater than the volume of oil required to lubricate the moving engine parts. Another aspect of the invention includes a method of maintaining the level of lubricant in an internal combustion engine and maintaining the quality of lubricating liquid.

DESCRIPTION OF THE DRAWINGS

The invention may be more readily understood by referring to the accompanying drawings, in which.

DESCRIPTION OF THE PREFERRED EMBODIMENT

Figure 1:
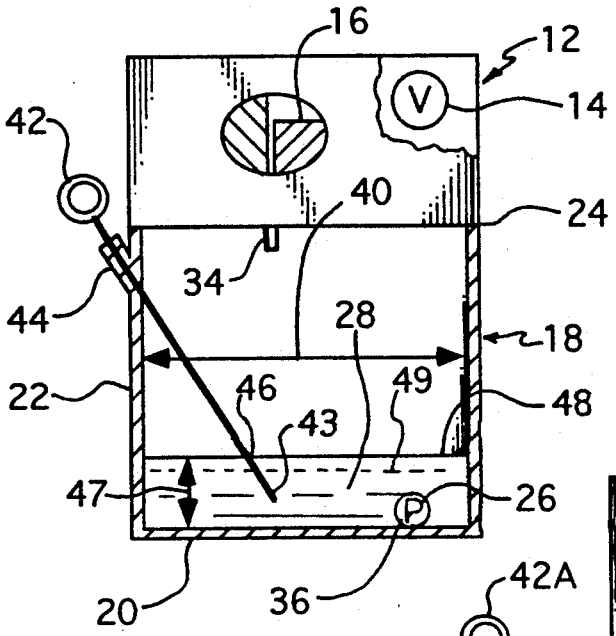
FIG. 1 (PRIOR ART)
FIG. 1 is a sectional end view of a prior art internal combustion engine mounting a typical oil pan or crank case.

Apparatus constructed according to the present invention, generally designated 10, is particularly adapted for use with an internal combustion engine, generally schematically designated 12 including a plurality of moving parts such as valve lifters schematically designated 14 and a reciprocating piston, generally designated 16. The typical prior art engine illustrated in FIG. 1 includes an oil pan or crank case, generally designated 18, having a bottom wall 20 and side walls 22 coupled to the underside 24 of the engine 12. An oil pump, schematically designated 26, is typically mounted internally of the crank case 18 for pumping oil or other lubricant, generally designated 28, to the moving parts 14, 16 to reduce the wear on the relatively moving parts. After lubricating the parts, the oil is returned via gravity or other conventional channels schematically designated 34 to the crank case 18.

In a typical prior art system, the pump 26 includes an inlet 36 which must be covered at all times. Because the breadth 40 of the oil pan 18 is relatively wide, substantially more oil 28 is required in the prior art pan 18 than that is required to lubricate the engine 12. For example, while only one-half quart of oil may be required to lubricate the engine 12, a total of five quarts of oil 28 may typically be stored in the pan 18 of an inoperative engine.

The typical prior art engine 12 includes a so-called "dip stick", generally designated 42, which is slidably mounted in a tubular mount 44 for movement between the position illustrated in FIG. 1 and a removed position. The depth of the oil at level 48 is represented by the arrows 47. As is ordinary, the dip stick 42 has graduations 46 thereon for determining whether or not the level 48 of the oil 28 is proper when the engine 12 is inoperative. If not, oil can be added. Through custom, such oil is normally added in one quart increments. When the engine 12 operates, the level of oil 28 drops to a lower predetermined level 49 illustrated in chain lines.

Figure 2:
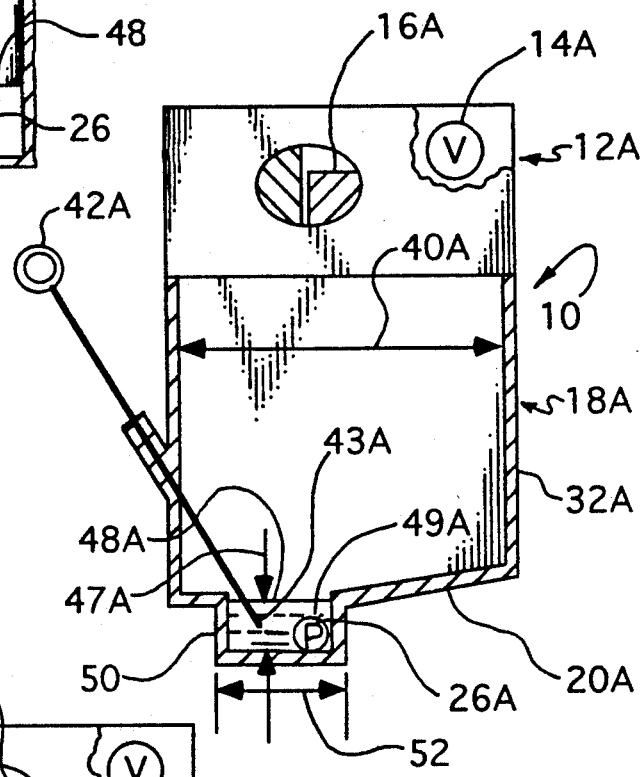
FIG. 2 is a similar sectional end view of an internal combustion engine including an oil pan having a deep well constructed according to the present invention.

The apparatus illustrated in FIG. 2 is similar in many respects to the apparatus illustrated in FIG. 1 and generally similar parts will be referred to by generally similar characteristics followed by the letter A. The oil pan 18A is differs from the oil pan 18 in that the bottom wall 20A is inclined toward a deep well 50 which has a breadth 52 substantially less than the breadth 40A of the oil pan side walls 32A. Accordingly, a substantially lesser volume of oil is required to fill the well 22 to the same depth 47A. The dip stick 42A includes a lower end 43A having graduations 46A which are received in the well 50.

When the engine 12 operates, the oil pump 26A will deliver oil 28A to the moving parts 14A and 16A so that the level of oil in the deep well 50 will lower from the level designated 48A to the substantially lower level indicated by chain lines at 49A.

Figure 3:
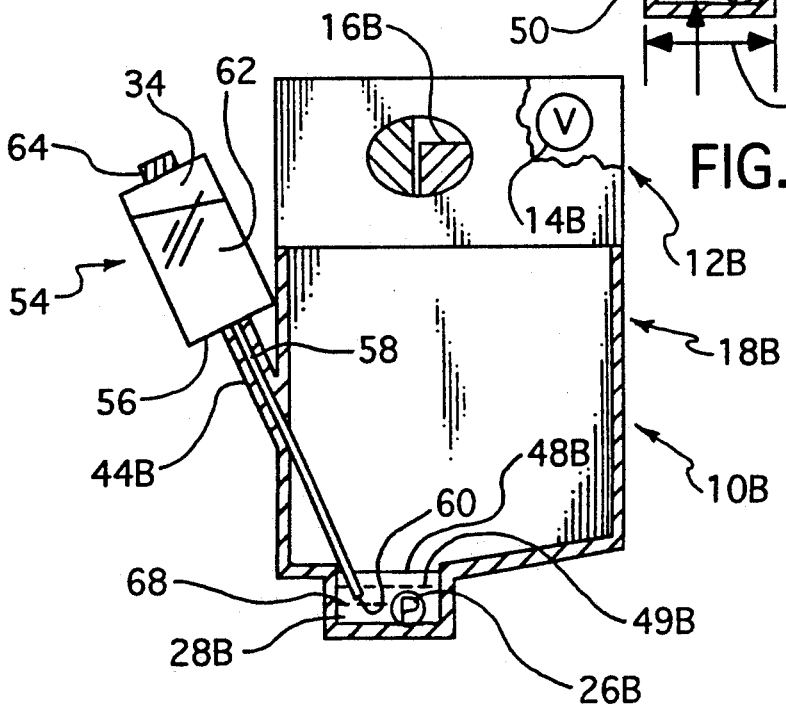
FIG. 3 is a sectional end view of a slightly modified construction including a make-up liquid lubricant system.

The embodiment illustrated in FIG. 3, includes generally similar parts which will be identified by generally similar characteristics followed by the letter B subscript.

Rather than a measuring dip stick 42A, the engine lubricating apparatus 10B includes an air impervious, air tight transparent or translucent container, generally designated 54, remote from the engine 12B via any suitable mount. The container 54 includes a lower discharge end 56 coupled to a conduit 58 having a downwardly opening, open lower end 60. The make-up liquid lubricant container, or reservoir 54, is filled with one-two quarts of make-up liquid lubricant 62 identical to the lubricant 28B in the oil pan 18B. The top wall of container 54 includes a removeable threaded, airtight cap 64 so that additional fluids 62 can be added when the supply is exhausted.

When the engine 12B and oil pump 26B are inoperative, the level 48B of the oil 28B is in the raised position illustrated in solid lines in FIG. 3 to completely envelope and close the lower conduit end 60 and thus the air pressure exerted on the oil 62 and the oil 28B will equalize and the vacuum created at 34 in the air tight container will preclude liquid 62 from flowing to the oil pan 10B.

When the oil pump 26B is operated to deliver lubricating oil 28B to the moving parts 12B and 16B, the oil level will drop to the illustrated in chain lines at 49B.

The opening 61 and the lower end 60 will be closed by the oil 28B so as to still preclude the flow of make-up oil 62 to the pan 10B.

If, as a result of dissipation leakage, etc., the level 68 drops below the opening 61, the force of gravity will cause liquid 62 to pass through the conduit 58 until the level 68 again rises to reach that illustrated in chain lines at 49B to close the open end 61.

THE OPERATION

With the engine 12 not operating and the parts stationary, the oil level in the oil pan 10B will rise to the level 48B. When the engine is operative and the parts are moving, the pump 26B will deliver oil lubricant to the moving parts 12B, 16B, to reduce the level of lubricant to that illustrated at 49B. The open end 61 of the conduit 58 remains covered and lubricant 62 is not permitted to escape therethrough.

As the lubricant becomes dissipated and the oil level drops below the level of opening 60 to the level illustrated by chain lines 68, the relative pressures will become unequalized, air will enter the conduit 58 through opening 60, and the force of gravity will cause make-up liquid to 62 to pass downwardly into the deep well 10B until the level 49B is again maintained. Accordingly, the system, constructed according to the present invention, continuously supplies lubricant in the system while the system is operating to ensure that an adequate supply is always maintained. The oil need never be changed in the engine as a relatively high percentage of new oil is constantly provided to the system and the parts are better lubricated than with the prior art lubricating systems. Accordingly, engines will last longer on substantially less lubricating oil than has been the case heretofore.

The system illustrated allows the in situ viewing of the oil level and eliminates the necessity of removing a conventional dip stick from 42 from the oil pan 18 and then visualizing the graduations 46. The user can view the level of oil in the translucent make-up lubricant 62 without moving the make-up reservoir 54.

ALTERNATE EMBODIMENT

Figure 4:
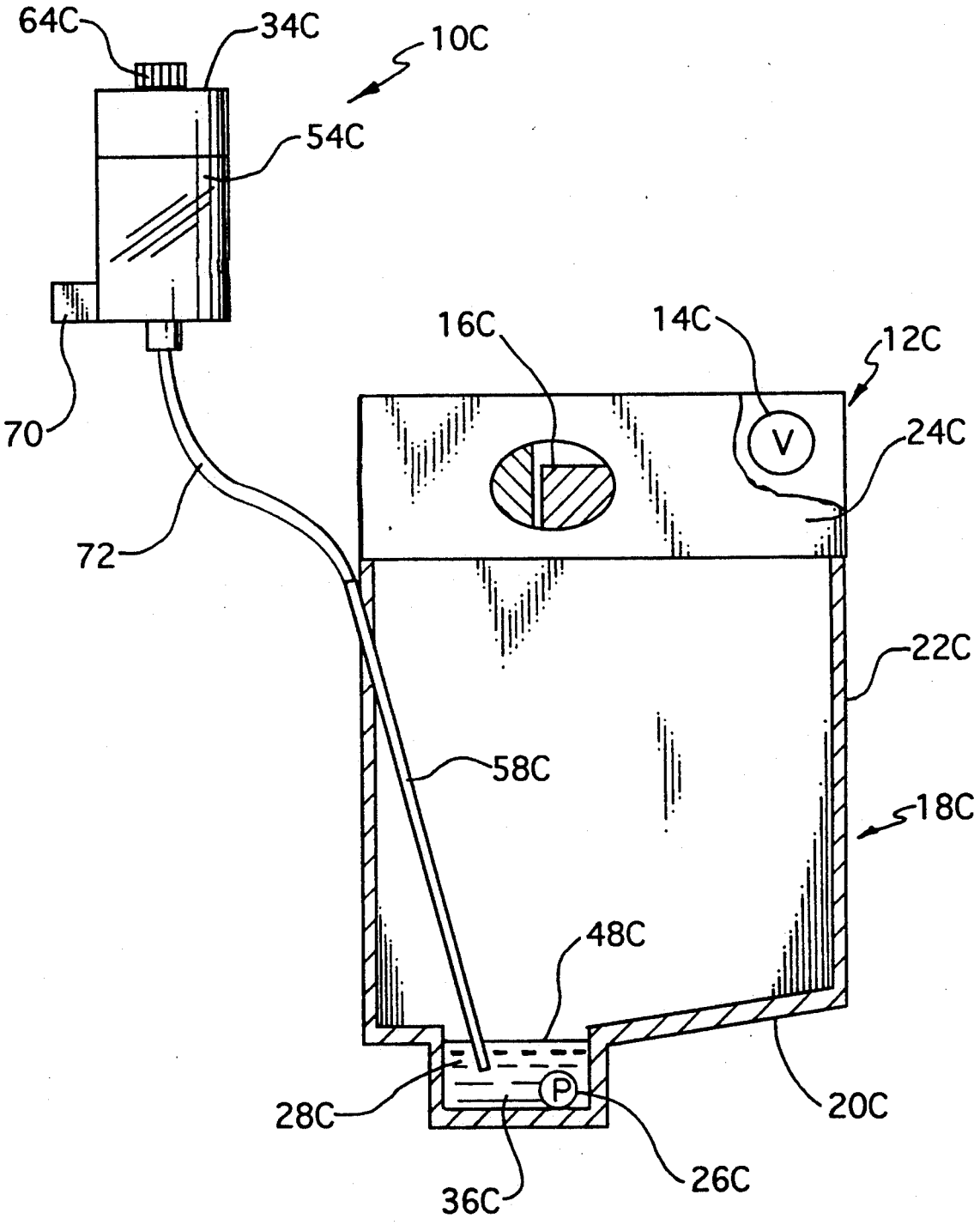
FIG. 4 is a slightly enlarged, sectional end view of another embodiment.

The apparatus illustrated in FIG. 4 includes similar parts which will be identified by similar characteristics followed by the letter C.

The reservoir 54C is mounted on a support bracket 70 removed from the engine 12C. The containers 54B and 54C are constructed of transluscent plastic or the like. The apparatus illustrated in FIG. 4 also includes a flexible conduit 72 which is coupled to a rigid conduit 58C. The tube 58C is a relatively rigid compared to the flexible tube 72. As is illustrated, the container 54C must be mounted at a level above the level 68.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. In combination with an internal combustion engine including an engine block mounting a plurality of moving parts and a predetermined volume of liquid lubricant for lubricating said moving parts;

a liquid lubricant container, having a bottom wall and a side wall, mounted on the underside of said block for receiving and passing liquid lubricant from said engine;

means for channeling said liquid lubricant from said moving parts to said container;

a lubricant receiving deep well provided in said bottom wall of said container for receiving lubricant from said container and storing all of said predetermined volume of lubricant when the engine is inoperative and said parts do not move;

means operable, when said parts move, for selectively supplying lubricant from said deep well to said moving parts to lubricate said parts and minimize wear of the moving parts as they move;

said means for supplying lubricant being operable to reduce the level of lubricant in said well from a raised predetermined level when said engine is inoperative and said parts are non-moving to a second predetermined lower level in said well when said engine is operating and said parts are moving; and make up lubricant means in open fluid communication with said well and responsive to said lubricant reaching a level lower than said second predetermined level for supplying make-up lubricant until the level of said lubricant in said well returns to said second predetermined level when said engine is operative and said parts are moving.

2. The combination set forth in claim 1 wherein said lubricant supply means includes a lubricant supply source and a conduit coupled to said source and having a terminal end received by said well at said second predetermined lower level for communicating lubricant from said lubricant supply source to said well when the level of said liquid in said well drops below said second predetermined level.

3. The combination set forth in claim 1 including lubricant level measuring means moveable between position received by said well and a removed position.

4. The combination set forth in claim 3 wherein said container has a predetermined breadth and said well has a substantially lesser predetermined breadth; said container including an inclined lower wall for channeling lubricant from said moving parts to said deep well.

5. In combination:

a liquid lubricant container for mounting on the underside of an internal combustion engine including a bottom wall having a deep well therein for storing a predetermined volume of engine lubricant at a predetermined level for lubricating an internal combustion engine;

pump means operative to remove lubricant from said deep well and pump it through said internal combustion engine and returning same to said deep well to reduce the level of lubricant in said deep well to a substantially lower level;

apparatus for maintaining the level of said lubricant in said deep well at said substantially lower level while said pump means is operative to pump said lubricant comprising:

an airtight tank of make-up liquid lubricant disposed above said substantially lower level and having a lower discharge end; and a conduit, having an upper end coupled to said lower discharge end of said tank, leading downwardly from said tank and having a downwardly opening, open-ended lower terminal end substantially at said substantially lower level for allowing make-up liquid lubricant in said tank to flow therethrough into said well under the force of gravity if the level of lubricant in said container drops below said substantially lower level and for precluding the flow of make-up liquid lubricant to said well when the level of lubricant in said well reaches said substantially lower level to close said lower terminal end.

6. The combination set forth in claim 5 wherein said deep well has a volume substantially less than the volume of said container for receiving and storing all of said lubricant when said pump means is inoperative; and said bottom wall is inclined for channeling lubricant from said engine to said deep well.

7. The combination set forth in claim 6 wherein said conduit is received by said deep well and is in open fluid communication with the lower end of said air tight tank and said deep well at said substantially lower level for communicating make up liquid to said well.

8. The combination set forth in claim 2 wherein said conduit includes an open ended lower terminal end positioned at said second predetermined level.

9. The combination set forth in claim 8 wherein said lubricant supply source comprises a lubricant supply container containing make-up liquid lubricant having one opening coupled to said conduit for supplying, via gravity forces, make-up lubricant.

10. The combination set forth in claim 9 including means for mounting said lubricant supply container in a position removed from said engine; said lubricant supply container comprising translucent material.

11. Apparatus for supplying make-up liquid lubricant to a deep well, provided in the bottom wall of a lubricant storage pan, normally filled with liquid engine lubricant to a predetermined level, said pan being coupled to an internal combustion engine which has lubricant circulating mechanism for circulating a predetermined volume of engine lubricant from said well to said engine and reduce the level of liquid lubricant in said well to a lower predetermined level, said apparatus comprising:

an air impervious reservoir mounted at a level above said lower predetermined level and having a lower discharge end;

said reservoir containing make-up liquid lubricant;

a gravity fed conduit having an upper end coupled to, and in open liquid communication with, said lower discharge end of said reservoir having a lower end received by said well and including an opening at said predetermined lower level for passing therethrough make-up liquid lubricant from said reservoir to said well when the level of lubricant in said well reaches a level below said predetermined lower level and for interrupting the flow of make-up lubricant from said reservoir to said well when said level of said lubricant reaches said predetermined lower level and closes said opening;

said bottom wall having a predetermined breadth and said storage pan including a side wall integral with said bottom wall for coupling to the underside of said engine; said well having a breadth substantially less than said predetermined breadth; said deep well storing all of said liquid lubricant when said liquid lubricant reaches said predetermined level; said bottom wall being downwardly inclined in a direction toward said well for directing liquid lubricant from said engine to said well.

12. In combination a liquid lubricant container, adapted to be mounted on the underside of an internal combustion engine, for storing a predetermined volume of liquid engine lubricant, said container including a bottom wall and an integral upstanding side wall for coupling to an internal combustion engine, said bottom wall including a lubricant receiving deep well for receiving and storing all of said engine lubricant;

pump means operable to remove lubricant from said deep well and deliver said lubricant to said engine and thence to return to said container;

said pump means being operative to reduce the level of lubricant in said deep well from a predetermined level to a substantially lower predetermined level; and make-up lubricant means for maintaining the level of said liquid lubricant in said deep well at said substantially lower predetermined level including airtight tank means for storing make-up liquid lubricant and having a lower discharge end, and conduit means coupled at its upper end to said lower discharge end of said tank means and including an open ended lower terminal end substantially at said lower predetermined level for allowing make-up liquid lubricant in said tank means to flow therethrough to said well under the force of gravity if the level of said liquid in said well drops below said lower predetermined level until the level of liquid in said well is raised to said lower predetermined level to close said lower terminal end.

* * * * *